US010663898B2

(12) United States Patent
Shinji et al.

(10) Patent No.: US 10,663,898 B2
(45) Date of Patent: May 26, 2020

(54) FIXING APPARATUS

(71) Applicant: CANON KABUSHIKI KAISHA, Tokyo (JP)

(72) Inventors: Takeshi Shinji, Yokohama (JP); Satoshi Nishida, Fujisawa (JP); Isamu Takeda, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/516,063

(22) Filed: Jul. 18, 2019

(65) Prior Publication Data

US 2020/0033774 A1 Jan. 30, 2020

(30) Foreign Application Priority Data

Jul. 27, 2018 (JP) ..... 2018-141078

(51) Int. Cl.
*G03G 15/20* (2006.01)
*H05B 3/14* (2006.01)

(52) U.S. Cl.
CPC ..... *G03G 15/2053* (2013.01); *G03G 15/2039* (2013.01); *G03G 15/2057* (2013.01); *H05B 3/145* (2013.01); *G03G 2215/2003* (2013.01); *G03G 2215/2035* (2013.01)

(58) Field of Classification Search
CPC ..... G03G 15/2039; G03G 15/2053; G03G 15/2057; G03G 2215/2003; G03G 2215/2035; H05B 3/145
See application file for complete search history.

(56) References Cited

U.S. PATENT DOCUMENTS

| | | | | |
|---|---|---|---|---|
| 9,696,671 | B1 * | 7/2017 | Massie | G03G 15/2057 |
| 9,829,839 | B2 * | 11/2017 | Ando | G03G 15/2046 |
| 10,466,631 | B1 * | 11/2019 | Owaki | G03G 15/2064 |
| 2011/0123238 | A1 * | 5/2011 | Kimura | G03G 15/2064 399/320 |
| 2014/0138372 | A1 * | 5/2014 | Ogura | G03G 15/2042 219/216 |

(Continued)

FOREIGN PATENT DOCUMENTS

| | | | |
|---|---|---|---|
| JP | 11-84919 | A | 3/1999 |
| JP | 2003-317898 | A | 11/2003 |

*Primary Examiner* — Ryan D Walsh
(74) *Attorney, Agent, or Firm* — Canon U.S.A., Inc. I.P. Division

(57) ABSTRACT

A fixing apparatus includes a heating member, a supporting member that supports the heating member, a film slidably disposed on the heating member, and a pressing member that forms a nip portion, in collaboration with the film, through which the recording medium is conveyed. The fixing apparatus further includes a first thermally conductive member and a second thermally conductive member that are disposed between the heating member and the supporting member. The first thermally conductive member has a thermal conductivity higher than that of a substrate of the heating member. The thermal conductivity in in-plane directions of the second thermally conductive member is higher than the thermal conductivity in a thickness direction thereof. The second thermally conductive member is in contact with the heating member, and the first thermally conductive member is in contact with the second thermally conductive member.

11 Claims, 10 Drawing Sheets

(56) References Cited

U.S. PATENT DOCUMENTS

| | | | | |
|---|---|---|---|---|
| 2014/0186078 | A1* | 7/2014 | Imaizumi | G03G 15/2017 399/329 |
| 2015/0023704 | A1* | 1/2015 | Imaizumi | G03G 15/2053 399/329 |
| 2015/0139706 | A1* | 5/2015 | Fujiwara | G03G 15/2064 399/329 |
| 2015/0153692 | A1* | 6/2015 | Matsubara | G03G 15/2053 399/329 |
| 2015/0338803 | A1* | 11/2015 | Hirose | G03G 15/2053 399/329 |
| 2016/0132006 | A1* | 5/2016 | Narahara | G03G 15/2053 399/329 |
| 2016/0139551 | A1* | 5/2016 | Narahara | G03G 15/55 399/33 |
| 2017/0102651 | A1* | 4/2017 | Tanaka | G03G 15/2053 |
| 2018/0181037 | A1* | 6/2018 | Kataoka | G03G 15/2053 |
| 2019/0196374 | A1* | 6/2019 | Adachi | G03G 15/2053 |
| 2019/0278206 | A1* | 9/2019 | Adachi | G03G 15/5004 |
| 2019/0339638 | A1* | 11/2019 | Kinukawa | G03G 15/2057 |
| 2020/0033775 | A1* | 1/2020 | Inoue | G05D 23/24 |

* cited by examiner

FIXING APPARATUS

BACKGROUND OF THE INVENTION

Field of the Invention

The present disclosure relates to a fixing apparatus to be used for an image forming apparatus, such as a printer or a copier.

Description of the Related Art

Many types of known image forming apparatuses, such as copiers, printers, or facsimile machines, employ an electrophotographic process using toner. A known fixing apparatus to be used in such image forming apparatuses uses a ceramic heater as a heating member, in which a pattern of a heating resistor is formed on a ceramic substrate, and also uses a fixing film, which is an cylindrically shaped rotatable endless belt that is heated by the heating member. In other words, the known fixing apparatus employs a film heating process in which the cylindrically shaped fixing film and a pressing roller press a recording medium that carries a toner image thereon. The fixing film and the pressing roller nip and convey the recording medium while heating the medium at a fixing nip portion and thereby fix the toner image onto the recording medium.

This film heating type fixing apparatus can use low heat capacity components for a ceramic heater and a fixing film, which can thereby raise the temperature of the components quickly to a level at which fixing is enabled. The film heating type fixing apparatus is advantageous in that the fixing apparatus can reduce wait time (accordingly, it can be used for on-demand operation due to its quick-start capability) and also can reduce power consumption. Moreover, the fixing apparatus can suppress the temperature increase inside the main body of the image forming apparatus.

When recording media (or small size sheets of paper) that have a width (a length in the longitudinal direction of the fixing apparatus) smaller than the maximum width that is printable (maximum size sheet of paper) are passed through the fixing apparatus, a phenomenon in which temperature in a non-sheet-passing region increases gradually occurs (also referred to as "temperature increase at the non-sheet-passing portion"). In the phenomenon of the temperature increase at the non-sheet-passing portion, the faster the printing, the more heat accumulates at the non-sheet-passing portion. This leads to the likelihood of the fixing apparatus being thermally damaged and affecting printing productivity.

One known approach to suppressing the temperature increase at the non-sheet-passing portion is to attach a thermally conductive member to the backside of a heating member such as a ceramic heater, which thereby improves the overall thermal conductivity in the longitudinal direction (Japanese Patent Laid-Open No. 11-84919). Another approach proposed is to use a graphite sheet as a thermally conductive member (Japanese Patent Laid-Open No. 2003-317898). The graphite sheet has anisotropy in thermal conductivity. Employing the graphite sheet enables the fixing apparatus to efficiently suppress the temperature increase at the non-sheet-passing portion, to reduce heat migration to a supporting body of the heating member, and to thereby improve thermal efficiency in fixing.

In recent years, image forming apparatuses have been desired to increase productivity further. In parallel with increasing productivity, the amount of heat accumulating in the non-sheet-passing portion has tended to increase, and more efficient heat equalization performance has been demanded. The amount of heat transport in the longitudinal direction of the thermally conductive member depends upon the product of cross-sectional area and thermal conductivity, in other words, depends upon the cross-sectional area of an individual thermally conductive member. Accordingly, to improve the heat equalization performance, it is effective to increase the thickness of a thermally conductive member and thereby increase the amount of heat transport.

However, when a metal plate is used as the thermally conductive member, increasing the thickness of the metal plate leads to a proportional increase in the heat capacity. As the heat capacity increases, the metal plate absorbs more heat generated by the heater at the start up of the fixing apparatus. This prolongs the time required to raise temperature to a level at which the fixing film can perform fixing. In the case of using an anisotropic material in thermal conductivity, such as a graphite sheet, as the thermally conductive member, increasing the thickness of the graphite sheet does not greatly increase the amount of heat transport of the graphite sheet because the graphite sheet has a low thermal conductivity in the thickness direction.

SUMMARY OF THE INVENTION

The present disclosure provides a fixing apparatus that can suppress temperature increase at a non-sheet-passing portion while suppressing prolongation of start-up time of the fixing apparatus caused by an increase in heat transport.

The present disclosure provides a fixing apparatus that includes a heating member including a substrate and a heating resistor formed on the substrate, a supporting member that supports the heating member, a film slidably disposed on the heating member, and a pressing member that forms a nip portion, in collaboration with the film, through which a recording medium is conveyed. The fixing apparatus further includes a first thermally conductive member and a second thermally conductive member. The first thermally conductive member has a thermal conductivity higher than that of the substrate. The second thermally conductive member has a thermal conductivity in in-plane directions and a thermal conductivity in a thickness direction, and the thermal conductivity in the in-plane directions is higher than the thermal conductivity in the thickness direction. The second thermally conductive member is in contact with the heating member, and the first thermally conductive member is disposed between the second thermally conductive member and the supporting member and is in contact with the second thermally conductive member.

Further features of the present disclosure will become apparent from the following description of exemplary embodiments with reference to the attached drawings.

DESCRIPTION OF THE EMBODIMENTS

The present disclosure will be described by using examples.

Example 1

Figure 1:
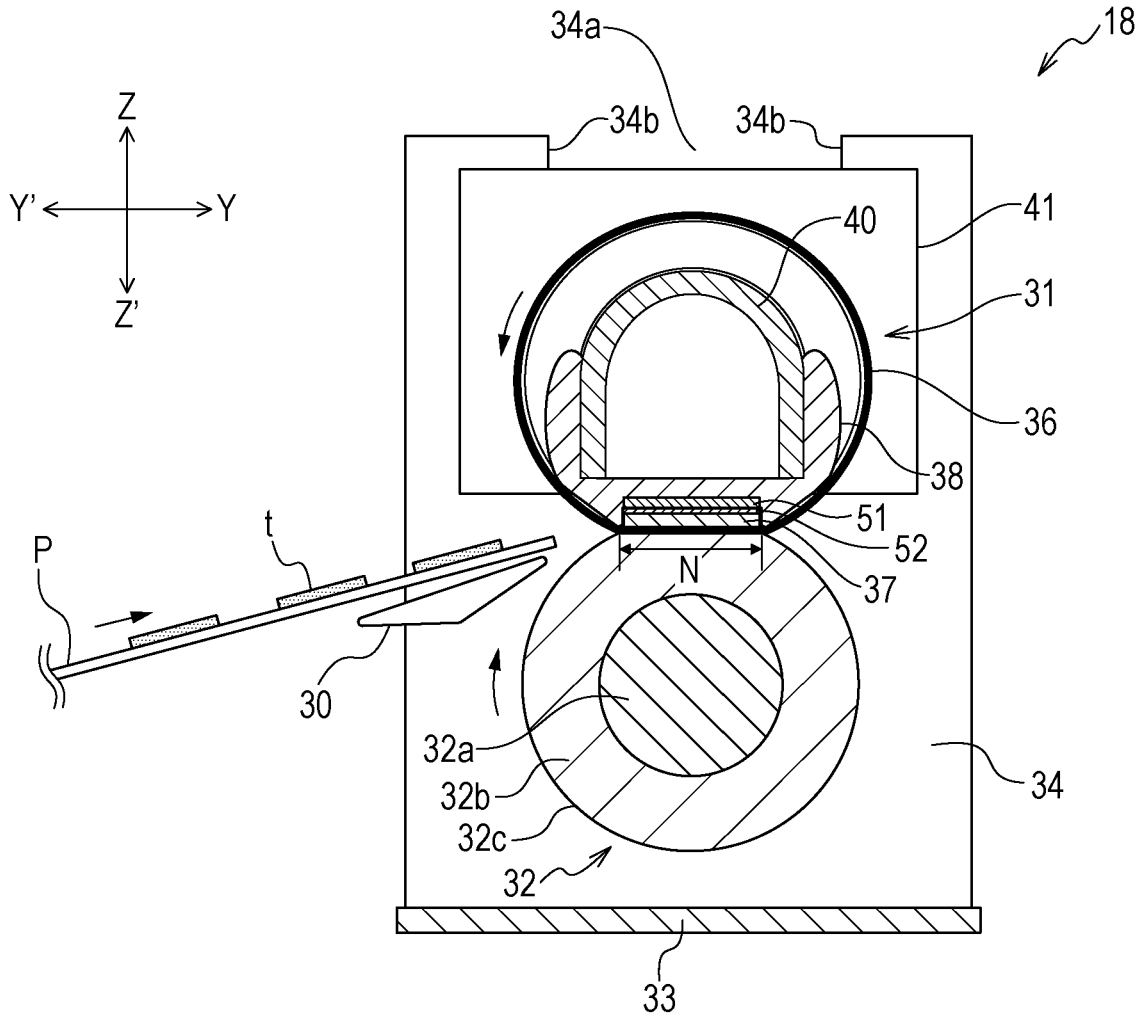
FIG. 1 is a schematic cross-sectional view illustrating a fixing apparatus according to Example 1.
Figure 2:
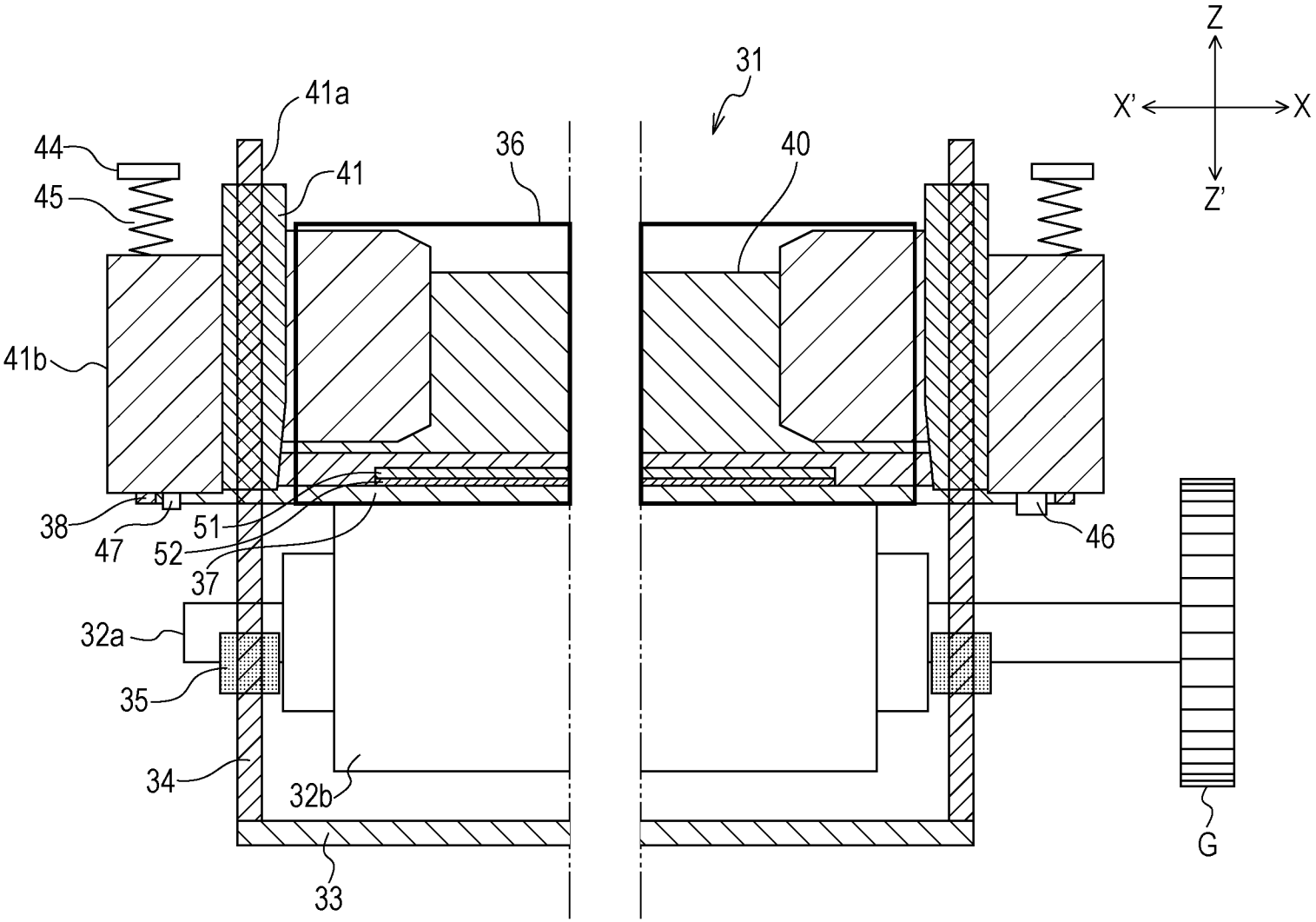
FIG. 2 is a schematic front view illustrating the fixing apparatus according to Example 1.

The following will describe Example 1 with reference to FIGS. 1 to 8. FIG. 1 is a schematic cross-sectional view illustrating a principal part of a fixing apparatus 18, and FIG. 2 is a schematic front view illustrating part of the fixing apparatus 18. In the following description on configurations of the apparatus, the longitudinal direction of the apparatus (the generating line direction of a fixing film 36) is parallel to the X-axis direction in the drawings. The width direction of the apparatus is parallel to the Y-axis direction, which is also a conveying direction of a recording medium, and the height direction is parallel to the Z-axis direction. In addition, an in-plane direction is a direction parallel to the plane defined by the X-axis and the Y-axis, and a thickness direction is parallel to the Z-axis direction.

The fixing apparatus 18 includes a film assembly 31 and a pressing roller 32. The film assembly 31 has a fixing film 36 that is a flexible and rotatable body, and the pressing roller 32 serves as a pressing member. The film assembly 31 and the pressing roller 32 are disposed between right and left side plates 34 of a apparatus frame 33 and are arranged vertically and substantially parallel to each other.

The pressing roller 32 includes a metal core 32*a*, an elastic layer 32*b* and a releasing layer 32*c* having releasing properties. The elastic layer 32*b* is made of a material such as a silicone rubber or a fluorocarbon rubber and is formed into a roller shape coaxially around the metal core 32*a*. The releasing layer 32*c* is made of a material, such as a tetrafluoroethylene-perfluoroalkyl vinyl ether copolymer (PFA), polytetrafluoroethylene (PTFE), or a tetrafluoroethylene-hexafluoropropylene copolymer (FEP), and is formed on the elastic layer 32*b*. The pressing roller 32 used in the present example is formed in such a manner that an approximately 3.5 mm thick silicone rubber layer 32*b* is formed, by using injection molding, around a stainless steel core 32*a* having an outer diameter of 11 mm and the silicone rubber layer 32*b* is subsequently covered with a 40 μm thick PFA resin tube 32*c*. The outer diameter of the pressing roller 32 is 18 mm. From a view point of providing a fixing nip portion N and securing durability, the hardness of the pressing roller 32 is desirably in the range from 40 to 70 degrees measured by using an ASKER-C hardness tester under a load of 9.8 N. In the present example, the hardness of the pressing roller 32 is set at 54 degrees. The rubber surface of the roller portion (i.e., the PFA resin tube 32*c*) of the pressing roller 32 is 226 mm long in the longitudinal direction. As illustrated in FIG. 2, the pressing roller 32 is disposed such that the metal core 32*a* is rotatably supported at both longitudinal ends by side plates 34 of the apparatus frame via respective bearing members 35. A drive gear G is fixed to one end of the metal core 32*a* of the pressing roller 32. The pressing roller 32 is rotationally driven by torque transmitted from a driving mechanism (not illustrated) to the drive gear G.

As illustrated in FIG. 1, the film assembly 31 includes, as main components, the fixing film 36, a ceramic heater 37 (hereinafter also referred to as a "heater 37") that serves as a heating member to heat the fixing film 36, a heater holder 38, a pressing stay 40, and right and left fixing flanges 41.

In the present example, the fixing film 36 is flexible and is constituted by a base layer made of a heat resistant resin, an elastic layer, and a releasing layer in order from inside out. In the present example, the base layer is 60 μm thick and is made of polyimide and formed into a cylinder. An approximately 150 μm thick silicone rubber layer, which serves as the elastic layer, is formed over the base layer, and the silicone rubber layer is covered with a 15 μm thick PFA resin tube, which serves as the releasing layer. In the present example, the fixing film 36 has an inner diameter of 18 mm.

As illustrated in FIG. 1, the heater holder 38 guides the fixing film 36 from inside. The heater holder 38 also serves as a supporting member that supports the heater 37. The heater holder 38 serves to guide the fixing film 36 that is fitted and rotated around the heater holder 38. The heater holder 38 also serves to hold the heater 37 in a thermally insulating manner. Moreover, the heater holder 38 serves as an opposing member against the pressing roller 32. In the present example, the heater holder 38 has a groove-like support portion that extends in the longitudinal direction and that supports the heater 37. The heater holder 38 is formed of a member having rigidity, thermal resistance, and heat-insulating properties, for example, made of a material such as a liquid crystal polymer.

Figure 3:
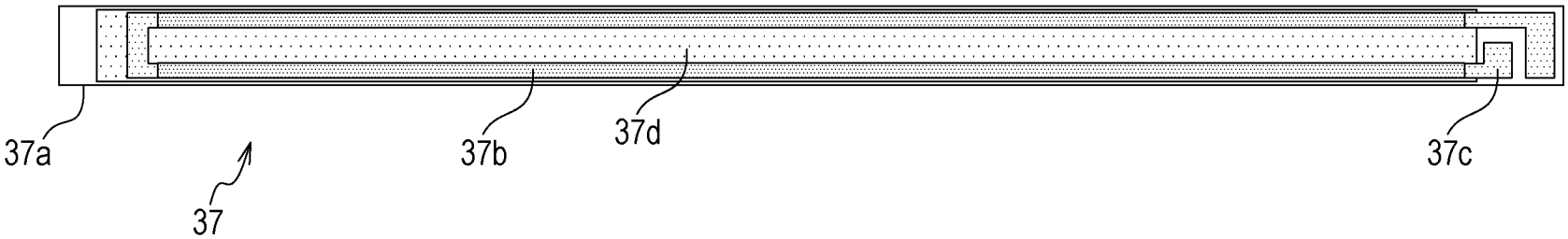
FIG. 3 is a diagram illustrating a ceramic heater according to Example 1.

As illustrated in FIG. 3, the heater 37 is formed in such a manner that a heating resistor 37*b* made of a material such as a silver palladium alloy is printed on a substrate 37*a* made of a ceramic such as alumina or aluminum nitride by using screen printing or the like. An electrode 37*c* made of silver or the like is subsequently connected to the heating resistor 37*b*. In the present example, two pieces of the heating resistor 37*b* are connected in series and have a total resistance of 18 ohm. The heating resistor 37*b* is covered with a glass coating 37*d*, which protects the heating resistor 37*b* and provides slidability against the fixing film 36. The heater 37 is disposed along the bottom of the heater holder 38 in the longitudinal direction.

Figure 4:
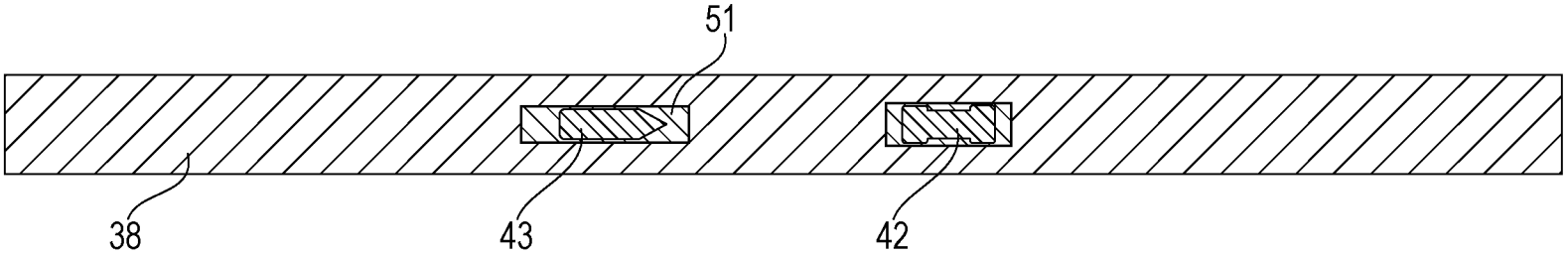
FIG. 4 is a diagram illustrating a thermistor and a thermal fuse according to Example 1.

FIG. 4 illustrates the heater holder 38 as viewed from above, in which a safety device and a temperature sensor are installed. Through-holes are formed in the heater holder 38, and a thermistor 42 serving as the temperature sensor and a thermal fuse 43 serving as the safety device are fitted on the back side of a metal plate 51 through respective through-holes. The thermistor 42 is formed such that a thermistor element is housed with a ceramic paper or the like interposed therebetween. The ceramic paper serves to stabilize the state of contact with the heater. The thermistor 42 is covered with an insulating material such as a polyimide tape. The thermal fuse 43 is a component for overheat protection. When the temperature of the heater rises abnormally, the thermal fuse 43 senses the abnormal heat from the heater and breaks the circuit temporally. The thermal fuse 43 includes a cylindrically-shaped metal housing and a fuse element installed therein. The fuse element melts at a predetermined temperature. The fuse element breaks the circuit when the temperature rises abnormally. The size of the thermal fuse 43 in the present example is such that a portion of the metal housing being in contact with the heater 37 is approximately 10 mm long and the metal housing is approximately 4 mm wide. The thermal fuse 43 is attached to the back side of the metal plate 51 via heat conductive grease that serves to prevent the thermal fuse 43 from operating improperly due to the thermal fuse 43 being detached from the heater 37.

The temperature of the heater 37 rises quickly by supplying electric power to the heating resistor via a power supply portion at an end of the heater 37. The thermistor 42 detects the temperature of the heater 37, and accordingly a control unit (not illustrated) controls the power supplied from the power supply portion to the heating resistor so as to maintain a predetermined temperature. As illustrated in FIG. 2, the heater 37 is mounted on the bottom of the heater holder 38, and the fixing film 36 is fitted around the heater holder 38. The pressing stay 40 is subsequently installed inside the heater holder 38. Right and left fixing flanges 41 are fitted on outward-extending right and left arms of the pressing stay 40. Thus, the film assembly 31 is assembled.

The heater holder 38 and the pressing stay 40 guide the film 36 from inside and also function as a nip forming member that forms a nip portion in collaboration with the pressing roller 32 with the film 36 interposed therebetween. Flanges 41, which are disposed near respective right and left edges of the film 36, function as restraining members that restrain the film 36 from moving in the longitudinal direction.

As illustrated in FIG. 1, the film assembly 31 is installed between the right and left side plates 34 of the apparatus frame 33 in such a manner that the film assembly 31 is disposed above the pressing roller 32 and substantially parallel to the pressing roller 32 with the heater 37 facing downward. The right and left fixing flanges 41 have respective vertical grooves 41*a*, and the vertical grooves 41*a* engage respective vertical edges 34*b* that defines vertical guide slits 34*a* formed in right and left side plates 34 of the apparatus frame 33. In the present example, the pressing stay 40 is an elongated rigid member having an inverted U-shape cross section and is made of a 1.6 mm thick stainless steel plate. The fixing flanges 41 are made of a liquid crystal polymer.

As illustrated in FIG. 2, pressing springs 45 are loaded between respective pressing arms 44 and corresponding pressing portions 41*b* of the right and left fixing flanges 41. The pressing springs 45 press the heater 37 via the right and left fixing flanges 41, the pressing stay 40, and the heater holder 38. The heater 37 is pressed against the upper surface of the pressing roller 32 at a predetermined pressure with the fixing film 36 nipped therebetween. In the present example, the pressure applied by the pressing springs 45 is set such that the total pressure applied to the fixing film 36 and the pressing roller 32 becomes 160 N. This pressure is exerted on the heater 37 against elastic forces of the fixing film 36 and the pressing roller 32. The heater 37 thereby presses the upper surface of the pressing roller 32 with the fixing film 36 nipped therebetween, which thereby forms an approximately 6 mm wide fixing nip portion N. At the fixing nip portion N, the fixing film 36 is nipped between the heater 37 and the pressing roller 32. The fixing film 36 is slidably bent along the flat bottom surface of the heater 37 with the inner circumferential surface of the fixing film 36 being in contact with the flat bottom surface of the heater 37.

The pressing roller 32 is rotationally driven clockwise in FIG. 1 at a predetermined speed by torque transmitted from the driving mechanism (not illustrated) to the drive gear G of the pressing roller 32. In conjunction with the rotation of the pressing roller 32, a rotation force is applied to the fixing film 36 due to friction between the pressing roller 32 and the fixing film 36 at the fixing nip portion N. The fixing film 36 is passively rotated counterclockwise in FIG. 1 around the heater holder 38 due to the rotation of the pressing roller 32 while the inner circumferential surface of the fixing film 36 is in contact with, and sliding on, the bottom surface of the heater 37. Note that a grease having heat resistant properties is applied onto the inner circumferential surface of the fixing film 36, which facilitate sliding of the inner circumferential surface of the fixing film 36 on the heater 37 and the heater holder 38.

A recording medium P is introduced in the state in which the fixing film 36 is rotated due to the rotation of the pressing roller 32 and the heater 37 is energized to raise the temperature of the heater to a predetermined level. The recording medium P that carries an unfixed toner image t is guided by an entry guide 30, which serves to guide the recording medium P accurately to the fixing nip portion N.

The recording medium P carrying the unfixed toner image t is inserted to the fixing nip portion N between the fixing film 36 and the pressing roller 32. The surface of the recording medium P that carries the toner image is brought into contact with the outer surface of the fixing film 36 at the fixing nip portion N. In this state, the recording medium P is nipped and conveyed together with the fixing film 36 through the fixing nip portion N. In the nipping and conveying process, the recording medium P is heated by the fixing film 36 that is heated by the heater 37. The unfixed toner image t carried on the recording medium P is heated and pressed onto the recording medium P. The toner image t is thereby melted and fixed onto the recording medium P. The recording medium P having passed through the fixing nip portion N is self-stripped from the surface of the fixing film 36 and is discharged, and conveyed further, by a discharge roller pair (not illustrated).

The substrate 37*a* of the heater 37 is an alumina plate having a length of 260 mm in the longitudinal direction, a width of 5.8 mm in the width direction, and a thickness of 1.0 mm. The heating resistor 37*b* of the heater 37 is 222 mm long in the longitudinal direction. The heating resistor 37*b* is formed so as to have the length longer than the width of a recording medium P of maximum size so that toner on a recording medium P can be fixed uniformly even in the case of using a recording medium P of maximum size (which is 216 mm wide in the present example) usable in the image forming apparatus.

Accordingly, in a region outside the width of the recording medium P, heat supplied by the heater 37 is not absorbed by recording media P and toner carried thereon, and the heat consequently accumulates in components, such as the fixing film 36, the heater 37, and the heater holder 38. In the case of a recording medium P being a sheet of paper, temperature tends to rise excessively in a region outside the recording medium P (also referred to as a "non-sheet-passing portion"), which is a phenomenon referred to as "temperature increase at the non-sheet-passing portion". The apparatus needs to be used below a certain level of temperature because components have an upper limit of service temperature. If temperature in the operating environment exceeds the upper limit, the components may be damaged. The smaller the width of the recording medium P relative to the length of the heating resistor 37*b*, the higher the temperature at the non-sheet-passing portion. Accordingly, it may be necessary to take a measure such as slowing down output so as to provide intervals between successive recording media P and thereby lower the temperature to a certain level or less. When the temperature increases at the non-sheet-passing portion, the heater 37 is subjected to heat stress due to temperature difference between a sheet-passing portion and a non-sheet-passing portion, which may damage the heater 37.

In this instance, a thermally conductive member having a thermal conductivity greater than that of the substrate 37*a* of the heater 37 (which is made of alumina having a thermal conductivity of 32 W/m·K in the present example) is disposed on the back side of the heater 37. This provides a heat equalization effect to level temperature differences in the longitudinal direction since heat at the high-temperature non-sheet-passing portion is transferred to the relatively low-temperature sheet-passing portion. The heat generated outside the recording medium P is thereby transferred via the thermally conductive member to the sheet-passing portion and further to the recording medium P. Accordingly, the heat can be utilized effectively and the temperature increase at the non-sheet-passing portion can be suppressed.

As image forming apparatuses have speeded up in recent years, the amount of heat accumulating in the non-sheet-passing portion has tended to increase, and more efficient heat equalization has been demanded. To improve the heat equalization performance, it is effective to increase the thickness of a thermally conductive member, in other words, to increase the cross-sectional area of the conductive member, which thereby increases the amount of heat transport.

However, when a metal plate is used as the thermally conductive member, increasing the thickness of the metal plate increases its heat capacity proportionally. If the heat capacity of the thermally conductive member (i.e., metal plate 51) increases, the metal plate 51 absorbs more heat generated by the heater 37 when the fixing apparatus is started up. This prolongs the time required to raise the temperature to a level at which the fixing film 36 is ready for fixing. A graphite sheet, which exhibits anisotropy in thermal conductivity, may be used as the thermally conductive member and may be made thicker. In this case, however, the amount of heat transport of the graphite sheet does not increase greatly since the thermal conductivity of the graphite sheet in the thickness direction is low. Graphite is a material that exhibits a very high heat equalization effect in the in-plane directions. In the thickness direction, however, graphite exhibits a low thermal conductivity and accordingly behaves like a heat insulating material. Moreover, in manufacturing, it is difficult to produce thick graphite sheets without compromising a high thermal conductivity in the in-plane directions. In general, as the thickness of a graphite sheet increases, the in-plane thermal conductivity of a produceable graphite sheet decreases. Accordingly, it is difficult to greatly suppress the temperature increase at the non-sheet-passing portion by increasing the thickness of the graphite sheet.

In the present example, on the other hand, the metal plate 51 that serves as a first thermally conductive member and a graphite sheet 52 that serves as a second thermally conductive member are disposed between the heater 37 and the heater holder 38. With this configuration, the fixing apparatus 18 can be started up quickly due to the graphite sheet 52 having a low thermal conductivity in the thickness direction. Moreover, when the temperature increases at the non-sheet-passing portion, the metal plate 51 having a larger cross-sectional area can transport a large amount of heat, which thereby suppresses the temperature increase at the non-sheet-passing portion. The following describes configurations of the present example and advantageous effects in detail.

Figure 5:
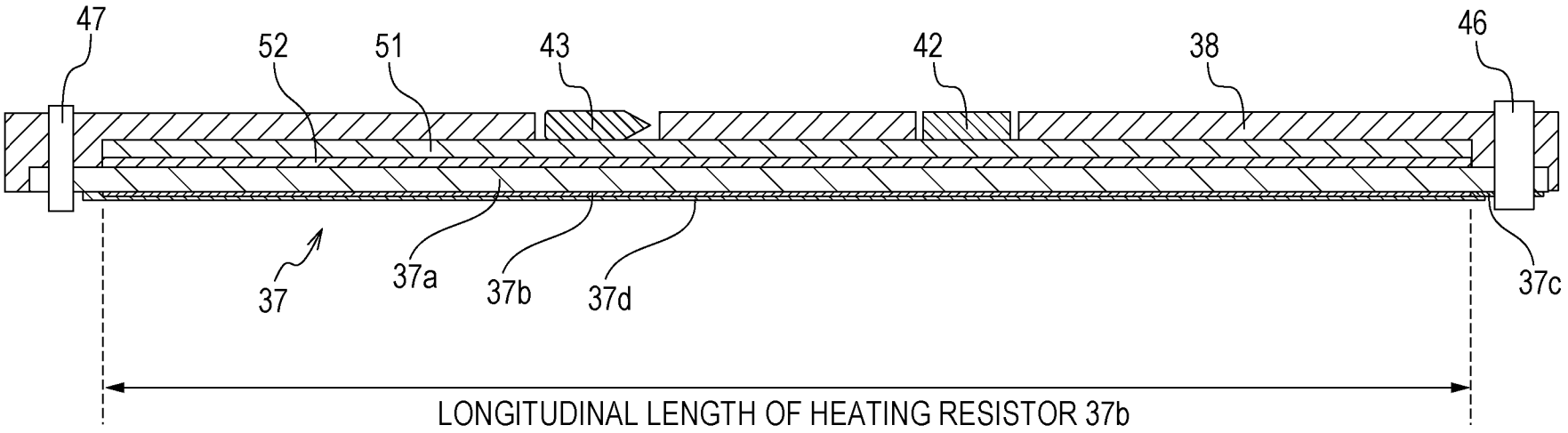
FIG. 5 is a diagram illustrating configurations and an arrangement of a metal plate and a graphite sheet according to Example 1.

Configurations and an arrangement of the metal plate 51 and the graphite sheet 52 will be described with reference to FIGS. 5 and 6. FIG. 5 is a schematic cross section illustrating part of the film assembly 31 cut in the longitudinal direction (the fixing film 36, the pressing stay 40, and the fixing flanges 41 are not illustrated). FIGS. 6A and 6B are diagrams respectively illustrating a power supply connector 46 and a heater clip 47 that serve as heater holding members.

As illustrated in FIG. 5, the heater holder 38 is underlain sequentially by the metal plate 51, the graphite sheet 52, and the heater 37. The power supply connector 46 and the heater clip 47 are holding members that are disposed at both longitudinal ends of the heater 37 and that pinch the heater 37 and the other components disposed on the heater holder 38 and combine them together. The thermistor 42 and the thermal fuse 43 are disposed through through-holes of the heater holder 38 so as to be in contact with the back side of the metal plate 51.

In the present example, the metal plate 51, which serves as the first thermally conductive member, has a thermal conductivity higher than that of the substrate 37*a* of the heater 37. The metal plate 51 is made of non-anisotropic pure aluminum that exhibits a thermal conductivity of 236 W/m·K. The graphite sheet 52 to be used as the second thermally conductive member has a thermal conductivity in the in-plane directions higher than that of the metal plate 51 and has a thermal conductivity in the thickness direction lower than that of the metal plate 51. The graphite sheet 52 is produced, for example, by sintering a polyimide sheet under a nonoxidative atmosphere. Graphite has such a structure that graphene layers in which carbon atoms are arranged in hexagonal structures are bonded by van der Waals forces. Due to this structure, a graphite sheet exhibits anisotropy in thermal conductivity, in which the thermal conductivity in directions parallel to the seat surface (in the in-plane directions) is very high whereas the thermal conductivity in a direction perpendicular to the seat surface (in the thickness direction) is low. The thermal conductivity of a graphite sheet, which varies depending on a specific production process and the sheet thickness, exhibits approximately 300 to 1500 W/m·K in the in-plane directions and approximately 2 to 10 W/m·K in the thickness direction. The graphite sheet 52 used in the present example exhibits a thermal conductivity of 1500 W/m·K in the in-plane directions and 3 W/m·K in the thickness direction. Note that it is preferable to use a graphite sheet 52 having a thermal conductivity of 300 W/m·K or more in the in-plane directions from a view point of suppressing the temperature increase at the non-sheet-passing portion and having a thermal conductivity of 10 W/m·K or less in the thickness direction from a view point of starting up the fixing apparatus 18 quickly.

In the present example, a 0.3 mm thick pure aluminum plate is used as the metal plate 51, and a 0.04 mm thick graphite sheet is used as the graphite sheet 52. Note that the graphite sheet 52 is preferably thinner than the metal plate 51 in order to obtain a high thermal conductivity in the in-plane directions. The graphite sheet 52 preferably has a thickness of 100 μm or less. Both of the metal plate 51 and the graphite sheet 52 have a length of 222 mm in the longitudinal direction and 5.8 mm in the width direction. By setting the length in the longitudinal direction to be the same as that of the heating resistor 37*b* of the heater, the effect of appropriately leveling temperature differences can be obtained.

Figure 6A:
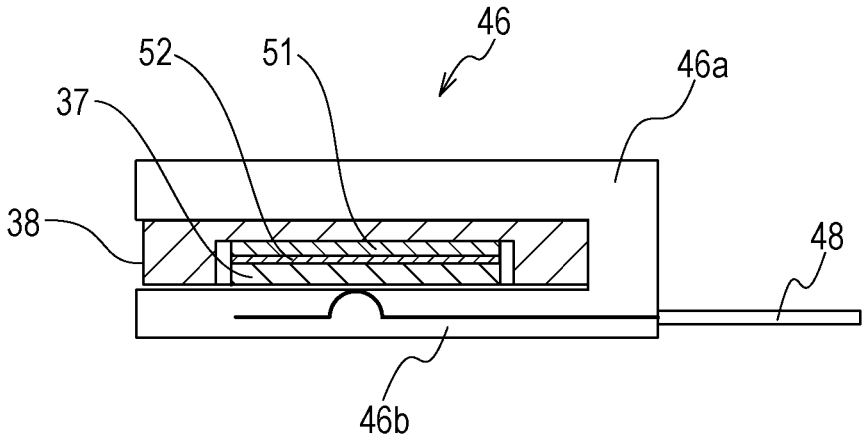
FIGS. 6A and 6B are diagrams respectively illustrating a power supply connector and a heater clip that serve as heater holding members according to Example 1.

As illustrated in FIG. 6A, the power supply connector 46 is formed of a contact terminal 46*b* and a housing 46*a*. The housing 46*a* is made of a resin and has a recess. The power supply connector 46 binds the metal plate 51, the heater 37, and the heater holder 38 together, in which the metal plate 51 is sandwiched between the heater 37 and the heater holder 38 while the contact terminal 46*b* is in electrical contact with the electrode 37*c*. Note that in the present example, the power supply connector 46 is also used as a heater holding member. However, the power supply connector 46 and the heater holding member may be formed as separate members and may separately provide functions of supplying electricity to the heater and serving as the heater holding member. The contact terminal 46*b* is connected to a wiring harness 48, and the wiring harness 48 is connected to an AC power source or a triac (not illustrated).

Figure 6B:
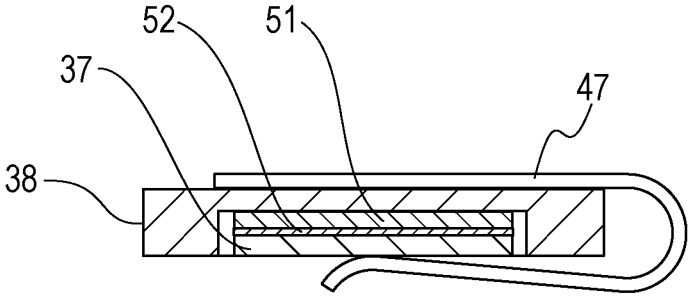

As illustrated in FIG. 6B, the heater clip 47, which is formed by bending a metal strip into a U-shape, holds the ends of the metal plate 51 and the heater 37 against the heater holder 38 by spring action. The end of the heater 37 held by the heater clip 47 is movable in the longitudinal direction of the heater holder 38. This prevents the heater 37 from being subjected to unnecessary loading caused by thermal expansion of the heater 37.

The heater holder 38, the metal plate 51, the graphite sheet 52, and the heater 37 are not fixed to each other so as to absorb bending deformation that may be caused by difference in thermal expansion or caused by pressing action. These members are brought into contact with each other by the spring action of the holding members and also by the pressing action of the pressing roller 32.

Next, advantageous effects of the present disclosure will be described with reference to Table 1 and FIGS. 7 and 8. In Table 1, the fixing apparatus according to the present example is compared with those of comparative examples. A fixing apparatus of Comparative Example 1 is configured such that the heater 37 and the heater holder 38 are in direct contact with each other without using any thermally conductive member. A fixing apparatus of Comparative Example 2 is configured to use only the metal plate 51 and not to use the graphite sheet 52. A fixing apparatus of Comparative Example 3 is configured to use a 0.5 mm thick metal plate 51 and not to use the graphite sheet 52. A fixing apparatus of Comparative Example 4 is configured to use only the graphite sheet 52 and not to use the metal plate 51. A fixing apparatus of Comparative Example 5 is configured to use a 0.06 mm thick graphite sheet 52 and not to use the metal plate 51. The graphite sheet 52 used in Comparative Example 5 exhibits a thermal conductivity of 1300 W/m·K in the in-plane directions.

TABLE 1

Configurations of Example 1 and Comparative Examples

| | Thickness of metal plate 51 | Thickness of graphite sheet 52 |
|---|---|---|
| Example 1 | 0.3 mm | 0.04 mm |
| Comparative Example 1 | none | none |
| Comparative Example 2 | 0.3 mm | none |
| Comparative Example 3 | 0.5 mm | none |
| Comparative Example 4 | none | 0.04 mm |
| Comparative Example 5 | none | 0.06 mm |

Fixing start-up time and temperature at the non-sheet-passing portion were measured for each of the above configurations. The fixing start-up time is the elapsed time from starting rotation of the pressing roller 32 and energizing the heater 37 from room temperature to the state in which the fixing apparatus is ready to fix a toner image t on a recording medium P. The temperature recorded at the non-sheet-passing portion is the highest temperature that the fixing film 36 reached when 200 A4 sheets of paper were passed through the fixing apparatus at a rate of 30 sheets per minute. Sheets of high white paper GF-C081 (a basis weight of 81.4 g/m$^2$) available from Canon were used as recording media P. An infrared thermography available from FLIR Systems, Inc was used to measure temperature. The width of the A4 sheet is 210 mm, which is 12 mm shorter (or 6 mm shorter at each side) than the 222 mm long heating element.

Figure 7:
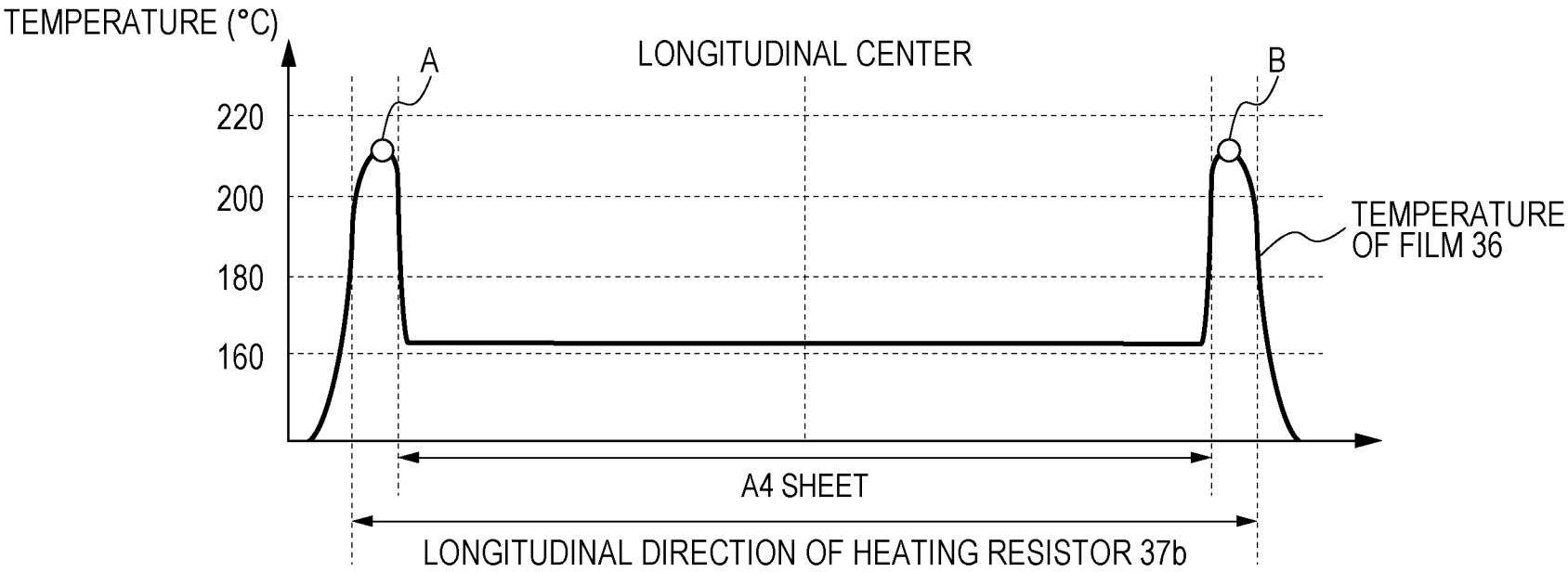
FIG. 7 is a chart illustrating temperature distribution of a fixing film in a longitudinal direction thereof when temperature increases at a non-sheet-passing portion.

FIG. 7 is a chart illustrating temperature distribution of the fixing film 36 in the longitudinal direction when temperature increases at the non-sheet-passing portion. The temperature increase occurs at the non-sheet-passing portions at both ends outside the width of the A4 sheet and inside the longitudinal length of the heating resistor 37*b* of the heater. Temperature at point A or point B in FIG. 7, whichever is higher, is adopted as the highest temperature. Temperature is measured at the fixing film 36 because in the present example, the silicone rubber used for the elastic layer of the fixing film 36 first reaches the upper limit of service temperature.

Figure 8:
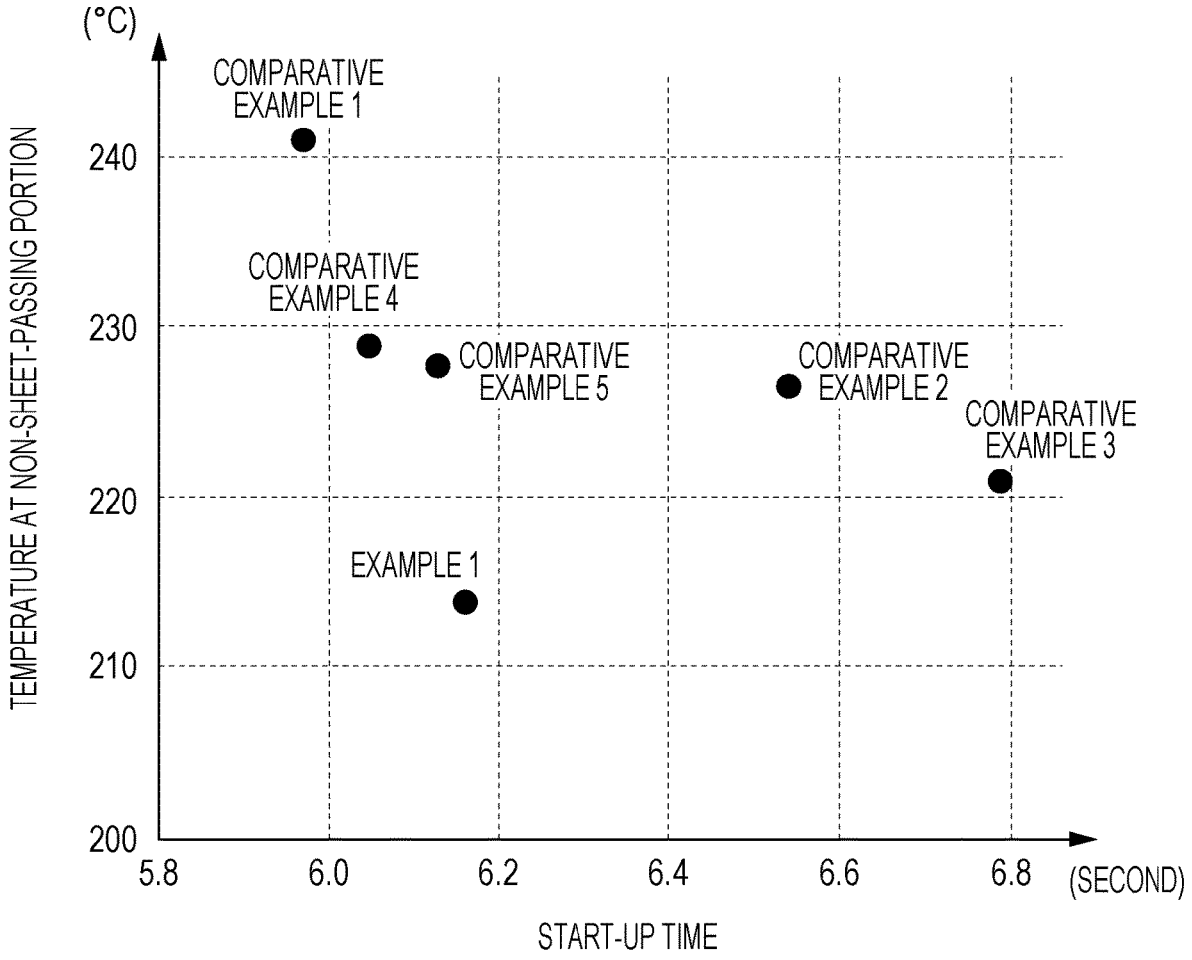
FIG. 8 is a graph depicting fixing start-up time and temperature increase at the non-sheet-passing portion in relation to Example 1.

FIG. 8 is a graph illustrating the fixing start-up time and the temperature increase at the non-sheet-passing portion for Example 1 and Comparative Examples 1 to 5. The fixing start-up time is desirably as short as possible, and the temperature increase at the non-sheet-passing portion is desirably as low as possible. Accordingly, the closer to the origin of the graph, the more desirable the results are.

The fixing start-up time of the fixing apparatus of Comparative Example 1, which does not use any thermally conductive member, is shortest while the temperature at the non-sheet-passing portion is highest. The temperature increase at the non-sheet-passing portion of the fixing apparatus of Comparative Example 2, which includes only the 0.3 mm thick metal plate 51, is more favorable compared with Comparative Example 1 while the fixing start-up time becomes longer. This tendency becomes more obvious for the fixing apparatus of Comparative Example 3, in which the thickness of the metal plate 51 is set to 0.5 mm. Accordingly, an increase in the cross-sectional area of the metal plate 51 has contradictory effects between the temperature increase at the non-sheet-passing portion and the fixing start-up time. This is because the increase in the cross-sectional area of the metal plate 51 causes an increase in the amount of heat transport, which improves the temperature at the non-sheet-passing portion but aggravates the fixing start-up time.

The fixing start-up time of the fixing apparatus of Comparative Example 4, which includes only the 0.04 mm thick graphite sheet 52, becomes shorter compared with Comparative Example 2, while the temperature increase at the non-sheet-passing portion remains at a similar level. This is due to the graphite sheet having a higher thermal conductivity in the in-plane directions and a lower thermal conductivity in the thickness direction. However, in Comparative Example 5 in which the thickness of the graphite sheet 52 is increased to 0.06 mm, the results are not greatly different from the results of Comparative Example 4. Since the graphite sheet 52 has a low thermal conductivity in the thickness direction, an increase in the thickness of the graphite sheet 52 does not greatly improve the heat equalization effect on the temperature increase at the non-sheet-passing portion, whereas the amount of heat absorbed by the graphite sheet 52 remains small during start up.

The fixing apparatus of Example 1 uses the graphite sheet 52 and the metal plate 51 together, which can shorten the fixing start-up time due to the graphite sheet 52 having a low thermal conductivity in the thickness direction. When the temperature increases at the non-sheet-passing portion, the fixing apparatus of Example 1 can reduce the temperature increase due to the graphite sheet 52 having a high thermal conductivity in the in-plane directions and also due to the metal plate 51 providing an additional amount of heat transport. Heat transfer during the fixing start-up is a phenomenon occurring for a relatively short period of time, and the graphite sheet 52 behaves like an thermal insulator in this situation. On the other hand, the temperature increase at the non-sheet-passing portion is a phenomenon occurring for a relatively long period of time, and heat is gradually transferred to the metal plate 51 via the graphite sheet 52. Accordingly, with the configurations of Example 1, both reducing the fixing start-up time and suppressing the temperature increase at the non-sheet-passing portion can be achieved at a higher level, compared with the comparative examples, by utilizing the anisotropy in thermal conductivity of the graphite sheet 52 in relation to the difference in duration for which the two phenomena occur.

As described above, according to Example 1, both the quick start of the fixing apparatus and the suppression of the temperature increase at the non-sheet-passing portion can be achieved consistently.

Example 2

Figure 9:
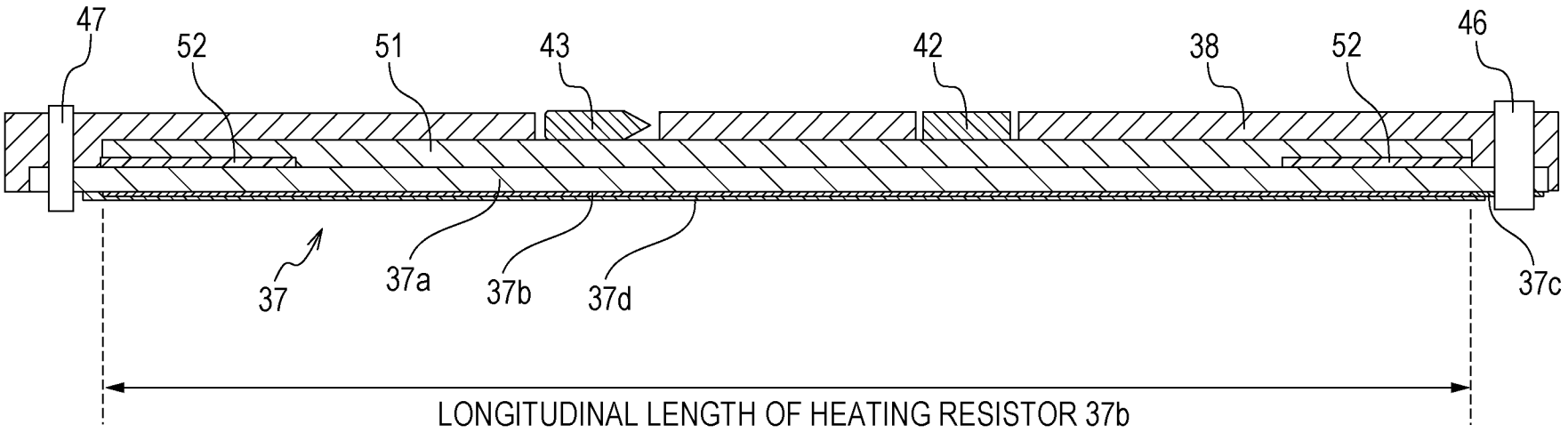
FIG. 9 is a diagram illustrating configurations and an arrangement of a metal plate and a graphite sheet according to Example 2.
Figure 10:
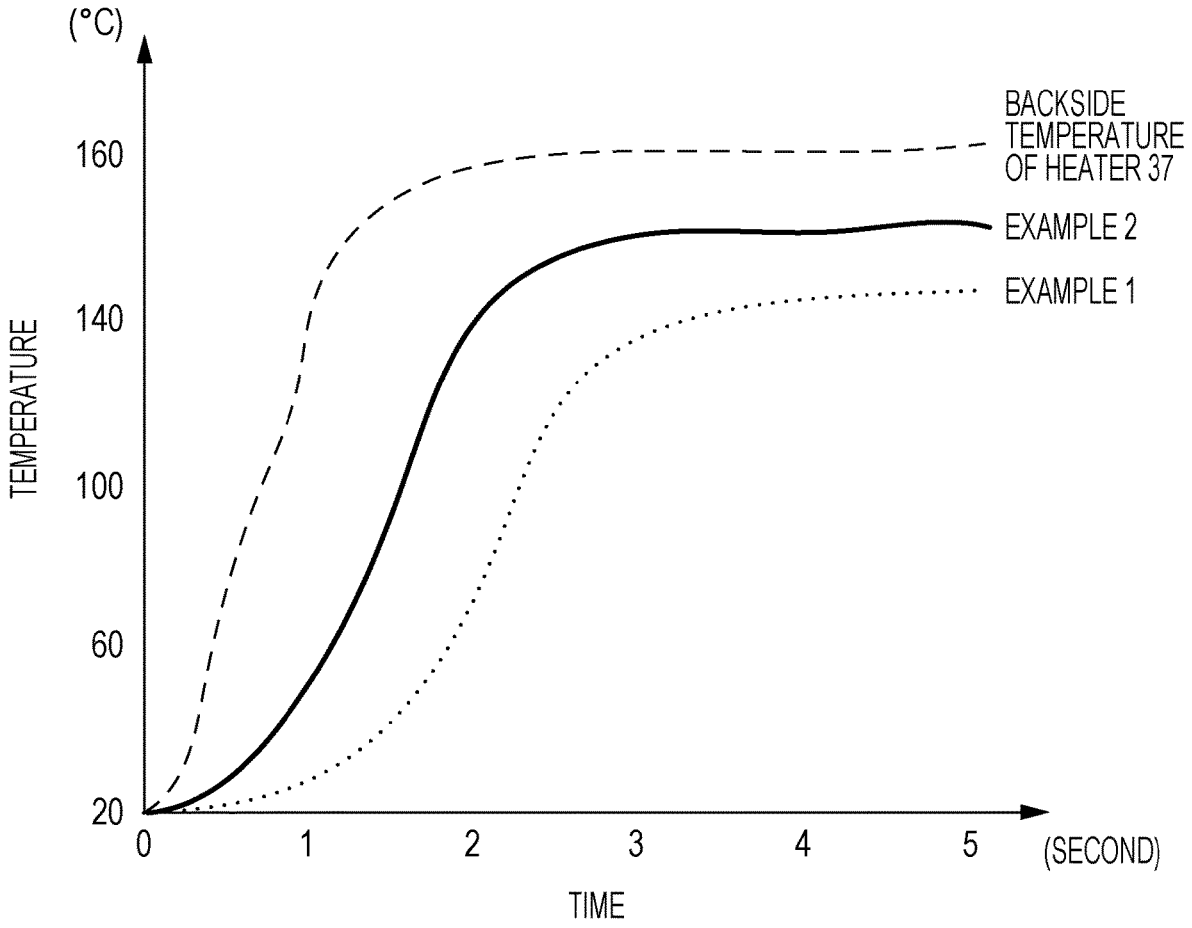
FIG. 10 is a graph depicting temperatures detected by a thermistor according to Example 2.

The following will describe Example 2 with reference to FIGS. 9 and 10.

Example 2 is different from Example 1 in that the graphite sheet 52 serving as the second thermally conductive member is disposed only at end portions in the longitudinal direction. Note that most of the configurations and operation of the apparatus are the same as those described in Example 1, and the following will describe only points different from Example 1.

In Example 1, the graphite sheet 52 is disposed over the entire length of the heating resistor 37*b* of the heater. In other words, the thermistor 42 that is the temperature sensor is disposed so as to be in contact with the back side of the metal plate 51 (i.e., the side opposite to the side having the heater 37), and the thermistor 42 is configured to measure the temperature of the heater 37 with the metal plate 51 and the graphite sheet 52 interposed therebetween. Since the graphite sheet 52 has a low thermal conductivity in the thickness direction, the response of the thermistor 42 is delayed when measuring the varying temperature of the heater 37.

In the present example, as illustrated in FIG. 9, graphite sheets 52 are disposed only at end portions in the longitudinal direction so that the thermistor 42 can measure the temperature of the heater 37 with only the metal plate 51 interposed therebetween. In the present example, the longitudinal length of each graphite sheet 52 was set 40 mm.

FIG. 10 is a graph depicting temperatures measured by thermistors 42 according to Examples 1 and 2 in comparison with backside temperatures of the heater 37 measured by a thermocouple when the heater 37 was heated. In the graph, temperatures measured by the thermistors 42 in Example 1 and in Example 2 are compared with the change of temperature (backside temperature) of the heater 37 (i.e., the target temperature to be measured), which can tell whether the thermistors 42 respond to the change of temperature of the heater 37 readily. The measurement results shows that the measured temperature in Example 2 is closer to the backside temperature of the heater 37 compared with Example 1 and thus can respond to the backside temperature more readily. Thus, with the configuration of Example 2, the fixing apparatus can measure the change of temperature more responsively, which can suppress overshooting in controlling the change of temperature of the heater 37 and can perform more precise temperature control.

In the present example, the inside ends of respective graphite sheets 52 that are disposed only at end portions are disposed at positions inside the width of the A4 sheet, which thereby provides the effect of suppressing the temperature increase at the non-sheet-passing portion to a level similar to that in Example 1 when A4 sheets are passed through.

Note that the central portion of the metal plate 51 absorbs more heat during start up because the central portion of the heater 37 is in direct contact with the metal plate 51 without interposing the graphite sheet 52. However, the temperature at which a toner image t can be fixed is determined depending on whether toner on both sides of the sheet can be fixed or not. The temperature at each end portion of the fixing film 36 is normally lower than the temperature at the center portion thereof due to heat dissipation and heat transfer from the end portions to peripheral components. Accordingly, the state of temperature of the fixing film 36 being higher at the center than at the end portions does not affect the fixing start-up time. The results of fixing start-up time in Example 2 were similar to those of Example 1.

As described above, Example 2 is advantageous in that the fixing apparatus can detect the temperature of the heater 37 more responsively compared with that of Example 1. However, in the case of using sheets of paper having a width shorter than the distance between the graphite sheets 52 that are disposed at both end portions, the fixing apparatus in Example 1 is more advantageous in suppressing the temperature increase at the non-sheet-passing portion.

As described above, the fixing apparatus uses aluminum as the first thermally conductive member both in Example 1 and in Example 2. However, the fixing apparatus may use other metals, such as copper. In addition, the fixing apparatus uses a graphite sheet as the second thermally conductive member. However, other materials may be used as far as they have anisotropy in thermal conductivity.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-141078, filed Jul. 27, 2018, which is hereby incorporated by reference herein in its entirety.

What is claimed is:

1. A fixing apparatus that fixes a toner image formed on a recording medium, the fixing apparatus comprising:

a heating member including a substrate and a heating resistor formed on the substrate;

a supporting member that supports the heating member;

a film slidably disposed on the heating member; and a pressing member that, in collaboration with the film, forms a nip portion through which the recording medium is conveyed, wherein the fixing apparatus further comprises a first thermally conductive member and a second thermally conductive member that are disposed between the heating member and the supporting member, the first thermally conductive member having a thermal conductivity higher than that of the substrate, the second thermally conductive member having a thermal conductivity in in-plane directions and a thermal conductivity in a thickness direction, the thermal conductivity in the in-plane directions being higher than the thermal conductivity in the thickness direction, and wherein the second thermally conductive member is in contact with the heating member, and wherein the first thermally conductive member is disposed between the second thermally conductive member and the supporting member and is in contact with the second thermally conductive member.

2. The fixing apparatus according to claim 1, wherein the thermal conductivity in the in-plane directions of the second thermally conductive member is higher than the thermal conductivity of the first thermally conductive member.

3. The fixing apparatus according to claim 1, wherein the thermal conductivity in the thickness direction of the second thermally conductive member is lower than the thermal conductivity of the first thermally conductive member.

4. The fixing apparatus according to claim 1, wherein the thermal conductivity in the in-plane directions of the second thermally conductive member is 300 W/m·K or more.

5. The fixing apparatus according to claim 1, wherein the thermal conductivity in the thickness direction of the second thermally conductive member is 10 W/m·K or less.

6. The fixing apparatus according to claim 1, wherein a material of the second thermally conductive member is graphite.

7. The fixing apparatus according to claim 6, wherein a material of the first thermally conductive member is a metal.

8. The fixing apparatus according to claim 1, wherein a thickness of the second thermally conductive member is thinner than that of the first thermally conductive member.

9. The fixing apparatus according to claim 1, wherein a thickness of the second thermally conductive member is 100 μm or less.

10. The fixing apparatus according to claim 1, wherein the second thermally conductive member is disposed only at an end portion in a longitudinal direction of the fixing apparatus.

11. The fixing apparatus according to claim 1, further comprising:

a temperature detection device that detects temperature of the heating member and is disposed so as to be in contact with the first thermally conductive member.

* * * * *